US008430541B2

(12) United States Patent
Ko

(10) Patent No.: US 8,430,541 B2
(45) Date of Patent: Apr. 30, 2013

(54) CEILING FAN WITH ILLUMINATION MECHANISM

(75) Inventor: Teng-Chen Ko, Changhua (TW)

(73) Assignee: Ching-Yang Ko, Changhua (TW)

( * ) Notice: Subject to any disclaimer, the term of this patent is extended or adjusted under 35 U.S.C. 154(b) by 192 days.

(21) Appl. No.: 13/158,554

(22) Filed: Jun. 13, 2011

(65) Prior Publication Data

US 2012/0313553 A1 Dec. 13, 2012

(51) Int. Cl.
*F21S 8/06* (2006.01)

(52) U.S. Cl.
USPC ..... 362/404; 362/147; 362/249.02; 362/800

(58) Field of Classification Search ..... 362/147–150, 362/249.02, 404–408, 800
See application file for complete search history.

(56) References Cited

U.S. PATENT DOCUMENTS 7,201,489 B2 * 4/2007 Shyu ..... 362/147

* cited by examiner

*Primary Examiner* — Jason Moon Han
(74) *Attorney, Agent, or Firm* — Jackson IPG PLLC

(57) ABSTRACT

A ceiling fan with an illumination mechanism includes a motor, a motor rotary disc, blades, a wire collection case, an annular LED lid and a lampshade. The motor includes a switch control circuit board to control LEDs provided on the annular LED lid. The annular LED lid is connected to the wire collection case. The wire collection case has a wire collection hole at a top thereof. The wires extend out from the switch control circuit board are confined in the LED lid. The wire collection case further has a pair of first pin holes at a bottom thereof. The LEDs are disposed around a lower portion of the LED lid to illuminate downward. The LED lid has two threaded hole at two sides of a bottom thereof. The lampshade has two corresponding holes for connection of screws. The LED lid has at least one pair of second pin holes at the lower portion thereof. The second pin holes correspond in position to the first pin holes of the wire connection case for connection of a pin. Thereby, through the switch control circuit board, the motor and the LEDs are respectively and selectively controlled by a power switch and the brightness of the LEDs is selectively controlled.

2 Claims, 5 Drawing Sheets

CEILING FAN WITH ILLUMINATION MECHANISM

BACKGROUND OF THE INVENTION

1. Field of the Invention

The present invention relates to a ceiling fan with an illumination mechanism, and more particularly to a ceiling fan coupled with an annular LED lid and a lampshade under a wire collection case to provide an illumination effect.

2. Description of the Prior Art

A conventional ceiling fan blows air toward the ground to provide a heat dissipation effect. When the ceiling fan is running, the ceiling fan will shake itself. There are a few ceiling fans with an illumination device on the market. In general, the illumination device comprises a light bulb mounted at a central portion thereof, which is somewhat dangerous. Accordingly, the inventor of the present invention has devoted himself based on his many years of practical experiences to solve this problem.

SUMMARY OF THE INVENTION

The present invention is to provide a ceiling fan with an illumination mechanism, which comprises a motor, a motor rotary disc, blades, a wire collection case, an annular LED lid and a lampshade. The motor rotary disc has a plurality of first locking holes around an inner peripheral portion thereof and a plurality of second locking holes around an outer peripheral portion thereof. The first locking holes are adapted for connection of a top end of the motor. The second locking holes are adapted for insertion of bolts which are inserted through apertures defined in a connection portion of each blade. The motor further comprises a switch control circuit board to control LEDs provided on the annular LED lid. The annular LED lid is connected to the wire collection case. The wire collection case has a wire collection hole at a top thereof. The wires extend out from the switch control circuit board are confined in the LED lid. The wire collection case further has a pair of first pin holes at a bottom thereof. The LEDs are disposed around a lower portion of the LED lid to illuminate downward. The LED lid has two threaded hole at two sides of a bottom thereof. The lampshade has two corresponding holes for connection of screws. The LED lid has at least one pair of second pin holes at the lower portion thereof. The second pin holes correspond in position to the first pin holes of the wire connection case for connection of a pin. Thereby, through the switch control circuit board, the motor and the LEDs are respectively and selectively controlled by a power switch to provide a heat dissipation effect and/or an illumination effect.

DETAILED DESCRIPTION OF THE PREFERRED EMBODIMENTS

Embodiments of the present invention will now be described, by way of example only, with reference to the accompanying drawings.

Figure 1:
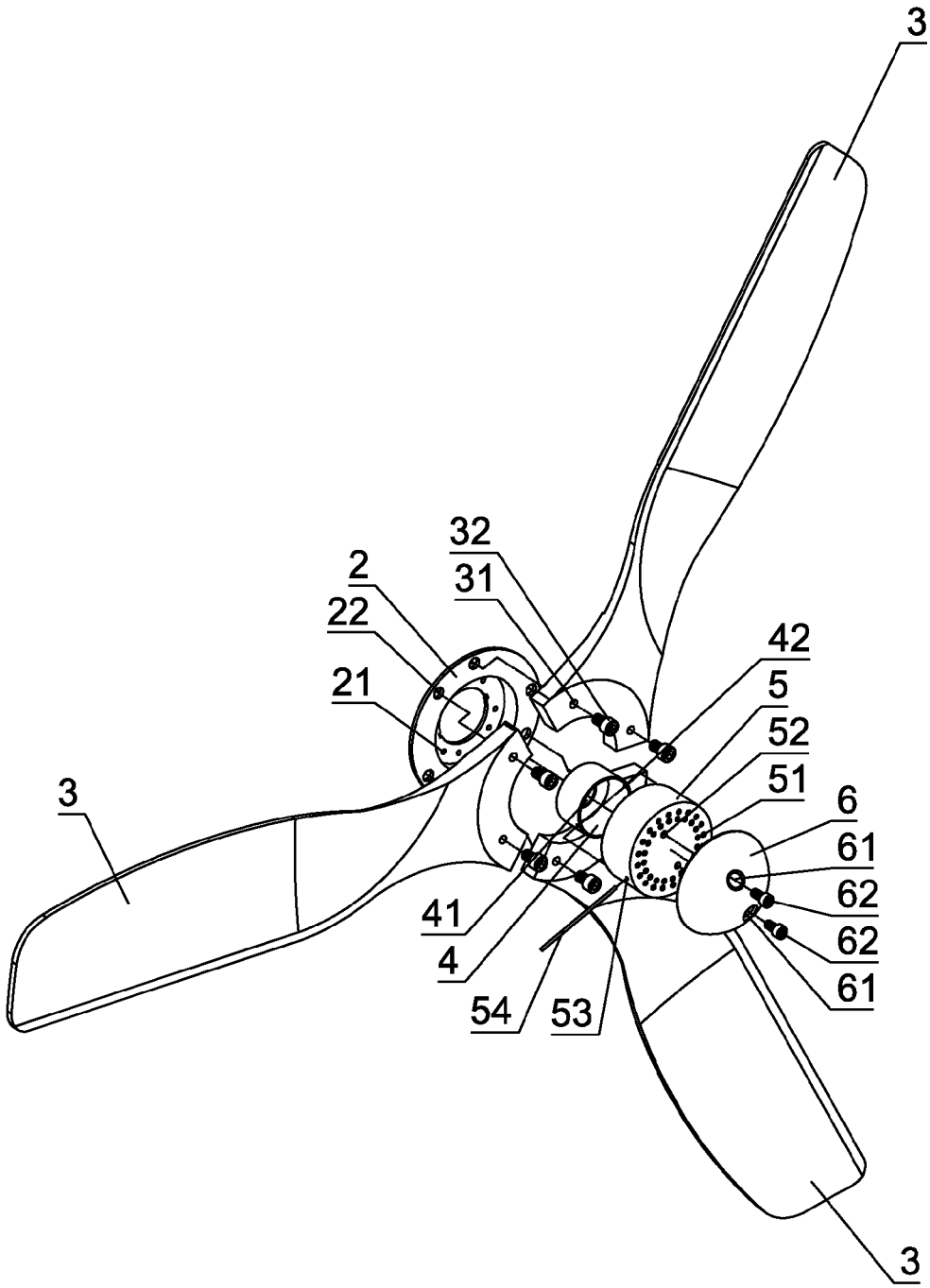
FIG. 1 is an exploded view according to a preferred embodiment of the present invention.
Figure 2:
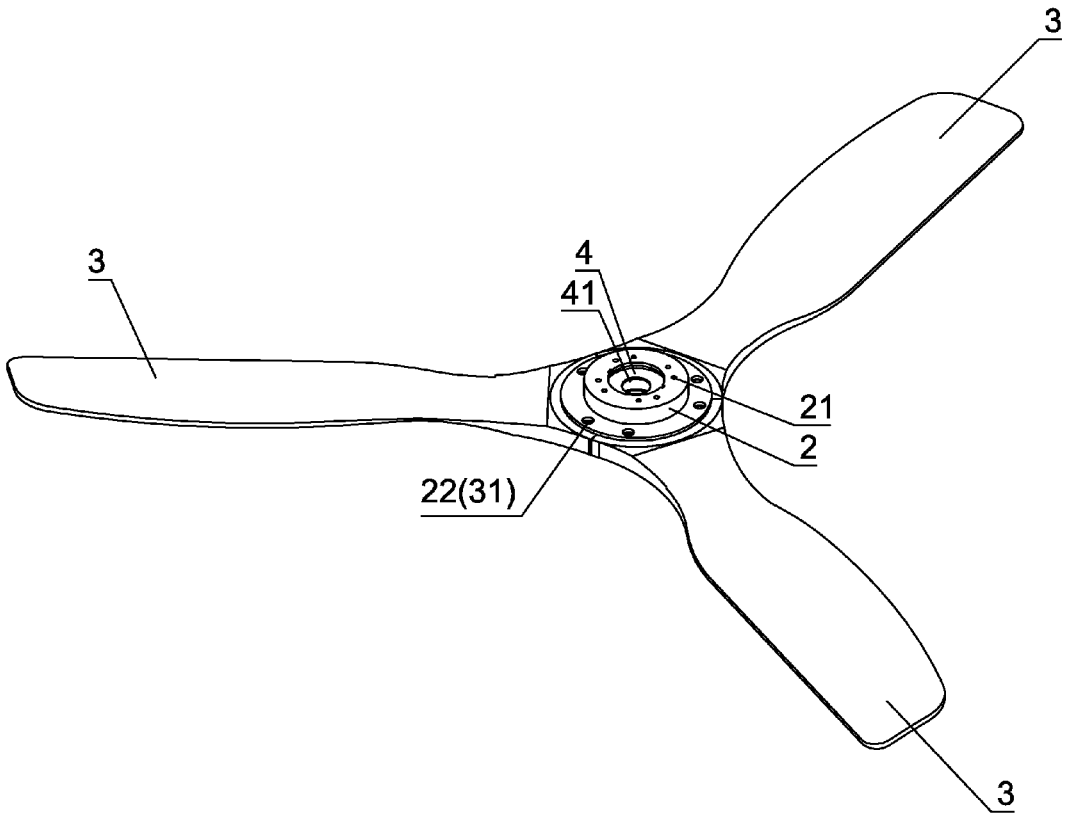
FIG. 2 is a perspective view according to the preferred embodiment of the present invention.
Figure 3:
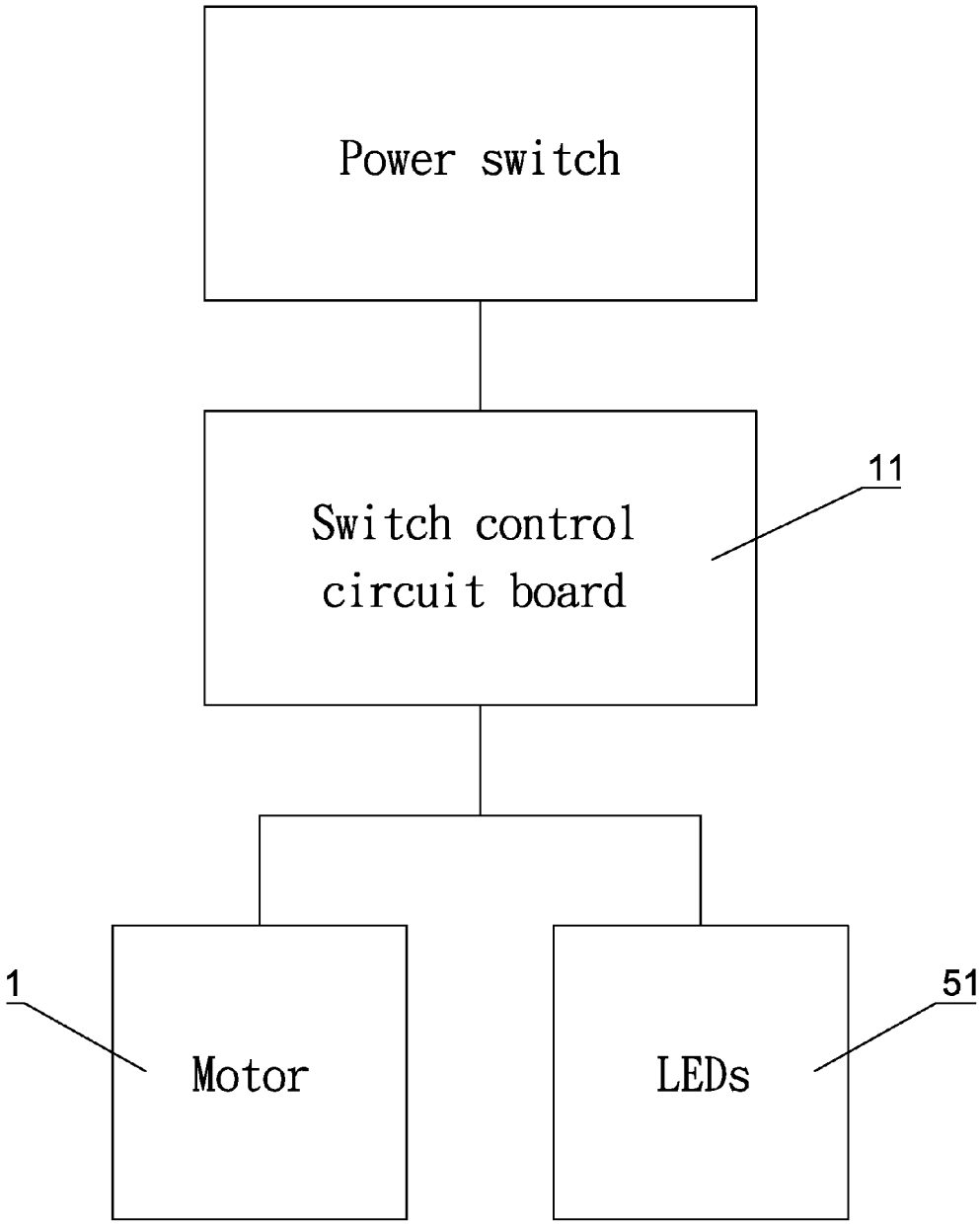
FIG. 3 is a diagram to show the control of the switch control circuit board according to the preferred embodiment of the present invention.

As shown in FIG. 1 through FIG. 3, a ceiling fan with an illumination mechanism of the present invention comprises a motor 1, a motor rotary disc 2, blades 3, a wire collection case 4, an annular LED lid 5, and a lampshade 6. The motor rotary disc 2 has a plurality of first locking holes 21 around an inner peripheral portion thereof and a plurality of second locking holes around an outer peripheral portion thereof. The first locking holes 21 are adapted for connection of a top end of the motor 1, and the second locking holes 22 are adapted for insertion of bolts 32 which are inserted through apertures 31 defined in a connection portion of each blade 3. The connection between the motor, the motor rotary disc and the blades is not the main feature of the present invention and will not be described hereinafter. The motor 1 further comprises a switch control circuit board 11 to control LEDs 51 provided on the annular LED lid 5. The annular LED lid 5 is connected to the wire collection case 4. The wire collection case 4 has a wire collection hole 41 at a top thereof. The wires extend out from the switch control circuit board 11 are confined in the LED lid 5. The wire collection case 4 further has a pair of first pin holes 42 at a bottom thereof. The LEDs 51 are disposed around a lower portion of the LED lid 5 to illuminate downward. The LED lid 5 has two threaded holes 52 at two sides of a bottom thereof and the lampshade 6 has two corresponding holes 61 for connection of screws 62. The LED lid 5 has at least one pair of second pin holes 53 at the lower portion thereof. The second pin holes 53 correspond in position to the first pin holes 42 of the wire connection case 4 for connection of a pin 54. The present invention provides not only a switch control effect but also an illumination effect.

Figure 4:
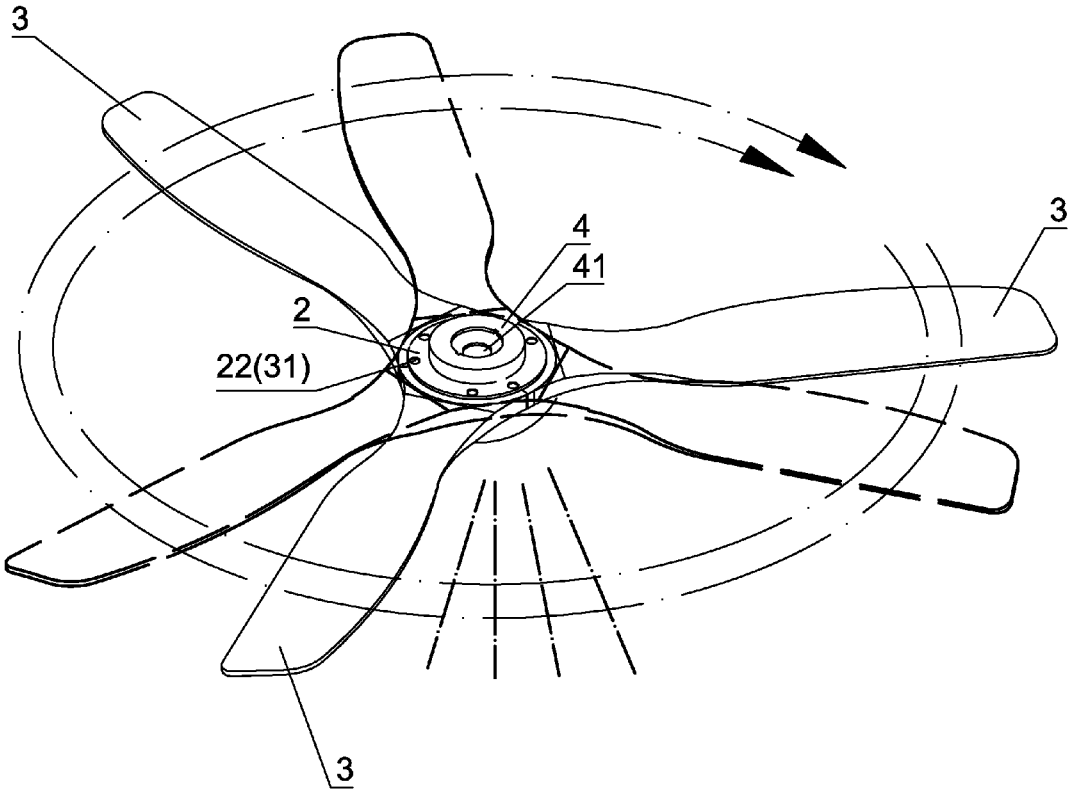
FIG. 4 is a schematic view according to the preferred embodiment of the present invention when in use.
Figure 5:
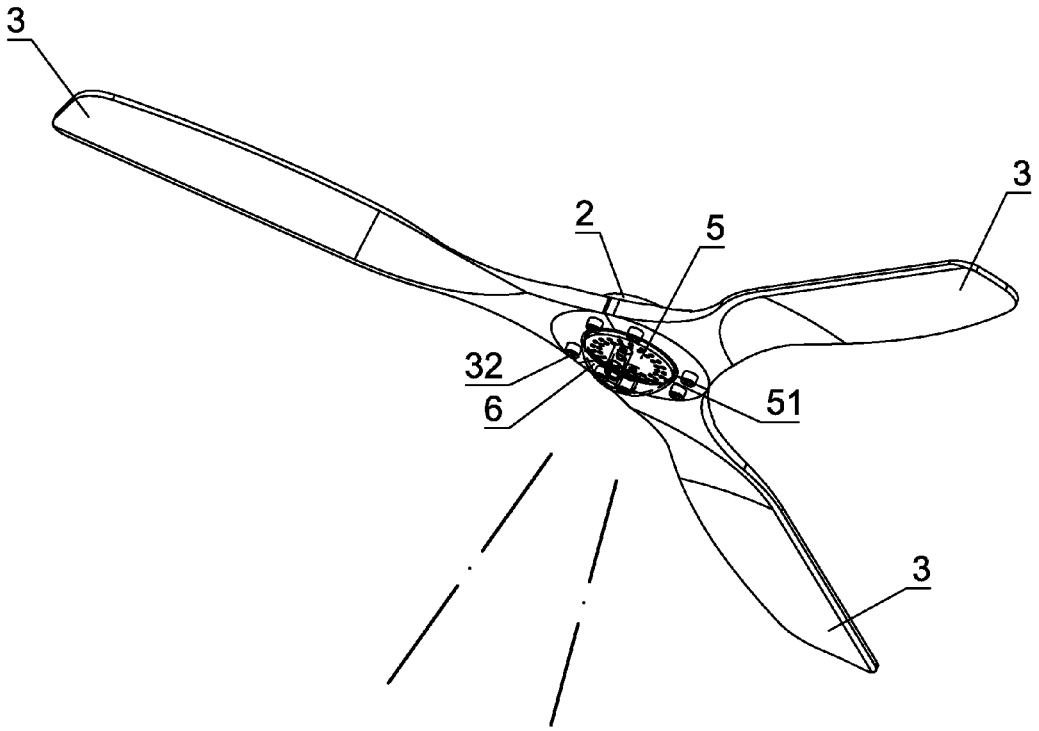
FIG. 5 is another schematic view according to the preferred embodiment of the present invention when in use.

Referring to FIG. 3 through FIG. 5, the motor 1 is coupled to the first locking holes 21 of the motor rotary disc 2 and the blades 3 are coupled to the second locking holes 22 of the motor rotary disc 2 by the bolts 32 inserting through the apertures 31. The pin 54 is inserted through the second pin holes 53 of the LED lid 5 and the first pin holes 42 of the wire collection case 4 for connecting the LED lid 5 to the wire collection case 4. The screws 62 are inserted through the holes 61 of the lampshade 6 and screwed to the threaded holes 52 of the LED lid 5. Through the switch control circuit board 11, the motor 1 and the LEDs 51 are respectively controlled by a power switch, as shown in FIG. 3. The motor 1 and the LEDs 51 can be switched on at the same time, as shown in FIG. 4; or the motor 1 is switched off and the LEDs 51 are switched on, as shown in FIG. 5; or the motor 1 is switched on and the LEDs 51 are switched off. Furthermore, the brightness of the LEDs 51 can be selectively controlled, providing an illumination effect at night.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan with an illumination mechanism, comprising a motor, a motor rotary disc, blades, a wire collection case, an annular LED lid and a lampshade, the motor rotary disc having a plurality of first locking holes around an inner peripheral portion thereof and a plurality of second locking holes around an outer peripheral portion thereof, the first locking holes being adapted for connection of a top end of the motor, the second locking holes being adapted for insertion of bolts which are inserted through apertures defined in a connection portion of each blade, characterized by: the motor further comprising a switch control circuit board to control LEDs provided on the annular LED lid, the annular LED lid being connected to the wire collection case, the wire collection case having a wire collection hole at a top thereof, wires extending out from the switch control circuit board being confined in the LED lid, the wire collection case further having a pair of first pin holes at a bottom thereof, the LEDs being disposed around a lower portion of the LED lid to illuminate downward, the LED lid having two threaded hole at two sides of a bottom thereof, the lampshade having two corresponding holes for connection of screws, the LED lid having at least one pair of second pin holes at the lower portion thereof, the second pin holes corresponding in position to the first pin holes of the wire connection case for connection of a pin, thereby, through the switch control circuit board, the motor and the LEDs being respectively and selectively controlled by a power switch.

2. The ceiling fan with an illumination mechanism as claimed in claim 1, wherein through the switch control circuit board, the LEDs are controlled by the power switch to switch on/off, and the brightness of the LEDs is selectively controlled.

* * * * *